US007300599B2

(12) United States Patent
Lunkwitz et al.

(10) Patent No.: US 7,300,599 B2
(45) Date of Patent: Nov. 27, 2007

(54) LUBRICANT FOR THE PRODUCTION AND TREATMENT OF LEATHER

(75) Inventors: Ralph Lunkwitz, Neustadt (DE); Andreas Seitz, Birkenheide (DE)

(73) Assignee: BASF Aktiengesellschaft (DE)

( * ) Notice: Subject to any disclaimer, the term of this patent is extended or adjusted under 35 U.S.C. 154(b) by 0 days.

(21) Appl. No.: 10/555,682

(22) PCT Filed: May 5, 2004

(86) PCT No.: PCT/EP2004/004765

§ 371 (c)(1),
(2), (4) Date: Feb. 2, 2006

(87) PCT Pub. No.: WO2004/099449

PCT Pub. Date: Nov. 18, 2004

(65) Prior Publication Data

US 2007/0021552 A1 Jan. 25, 2007

(30) Foreign Application Priority Data

May 6, 2003 (DE) ..... 103 20 110

(51) Int. Cl.
*C14C 9/02* (2006.01)

(52) U.S. Cl. ..... 252/8.57; 8/94.1 R; 8/94.23; 427/389; 524/556

(58) Field of Classification Search ..... 8/94.1 R, 8/94.23; 252/8.57; 524/556; 427/389
See application file for complete search history.

(56) References Cited

U.S. PATENT DOCUMENTS

| | | | | |
|---|---|---|---|---|
| 4,314,802 A | | 2/1982 | Beier et al. | |
| 4,470,825 A | * | 9/1984 | Landbeck et al. | 8/94.23 |
| 5,348,807 A | | 9/1994 | Hodder et al. | |
| 5,853,427 A | * | 12/1998 | Kronick | 8/94.23 |
| 6,048,467 A | | 4/2000 | Dahmen et al. | |
| 6,133,372 A | | 10/2000 | Lohmann et al. | |
| 2004/0216241 A1 | * | 11/2004 | Pabst et al. | 8/94.15 |
| 2005/0224745 A1 | * | 10/2005 | Lunkwitz | 252/8.57 |

FOREIGN PATENT DOCUMENTS

| | | |
|---|---|---|
| DE | 41 42 318 | 1/1999 |
| DE | 101 43 949 | 3/2003 |
| EP | 0 466 392 | 1/1992 |
| EP | 0 498 634 | 8/1992 |
| EP | 0 753 585 | 1/1997 |
| EP | 0 927 271 | 7/1999 |
| RO | 105-045 | 7/1992 |

* cited by examiner

*Primary Examiner*—Anthony J Green
(74) *Attorney, Agent, or Firm*—Connolly Bove Lodge & Hutz LLP

(57) ABSTRACT

Fatliquoring agents for the production and/or for the treatment of leather comprising
(A) at least one natural lipoid;
(B) at least one polymer based on the monomers acrylic acid and/or methacrylic acid;
(C) an emulsifier composition containing a $C_6$- to $C_{17}$-alkanol alkoxylated with up to 12 alkylene oxide units or a mixture of two or more such alkanols and a $C_{12}$- to $C_{24}$-fatty alcohol mixture alkoxylated with at least 15 alkylene oxide units.

15 Claims, No Drawings

LUBRICANT FOR THE PRODUCTION AND TREATMENT OF LEATHER

RELATED APPLICATIONS

This application is a national stage application (under 35 U.S.C. 371) of PCT/EP2004/004765 filed May 5, 2004 which claims benefit to German application 103 20 110.6 filed May 6, 2003.

The present invention relates to a composition which contains natural lipoid, synthetic polymer and a specific mixture of various alkoxylated alkanols and can preferably be used both in the production and in the treatment of leather, and the use of this fatliquoring agent in the production and/or treatment of leather. The present invention also relates to a process for the fatliquoring of leather using the composition according to the present invention. Furthermore, the present invention describes the use of a special emulsifier composition for the production and/or treatment of leather and for the preparation of a fatliquoring agent for the production and/or treatment of leather.

Fatliquoring agents are used in leather production for softening the leather, for increasing its body and strength and for a protective effect against moisture, dirt and external chemical influences (cf. H. Herfeld, Bibliothek des Leders 4 (1985), 13 et seq.). Commercial fatliquoring agents are products which as a rule consist of chemically modified natural fats, oils, waxes, resins and derivatives thereof and/or mineral oil fractions and secondary products thereof (cf. H. Herfeld, Bibliothek des Leders 4 (1985), 59 et seq.)

In particular, high-quality leathers, for example automotive upholstery leathers, have to fulfill certain criteria. On the one hand the softness, on the other hand the fastness to light and effects of heat and finally the so-called fogging behavior are important. DIN 75201 defines fogging as condensation of vaporized volatile components from the interior trim of the vehicle on the glass panes, in particular on the windscreen. The same standard also describes a gravimetric and a reflectometric method for characterizing the fogging behavior of leather.

EP 0 498 634 A2 recommends special polymers for the production of so-called low-fogging leather, the aqueous dispersions being substantially free of organic solvents and containing an amphiphilic copolymer which consists of a predominant proportion of at least one hydrophobic monomer and a small proportion of at least one hydrophilic monomer. The treatment of leathers with these dispersions leads to good results in a gravimetric test according to DIN 75201. Reflectometric investigations were not disclosed. The preparation of these amphiphilic copolymers is preferably be effected in an aqueous emulsion polymerization. However, owing to the different hydrophilic properties of the monomers to be used, this naturally leads to problems in the copolymerization behavior which, in the extreme case, can result in each of the monomers by themselves forming homopolymers in an undesirable manner. A further consequence of the essentially unfavorable solution behavior is complicated working-up for destruction of residual monomers. Moreover, in order to achieve good emulsion stability, it is necessary to add a sufficient amount of emulsifier (lauryl sulfate was used in the examples mentioned), which can lead to wastewater problems in leather processing.

EP 0 466 392 B1 describes a process for the preparation of polymers which contain both hydrophobic side groups and alkoxylated side groups and are obtained by derivatizing polymers after the actual polymerization process by conventional methods. Thus, polymers are preferably prepared from simple monomers, such as acrylamide and/or acrylic acid, by conventional polymerization and then derivatized with a mixture of primary or hydrophobic amines and primary or secondary alkoxylated amines. Such derivatized polymers are used as thickeners and dirt solvents.

EP 0 927 271 B1 describes a further process for the preparation of polymers which are prepared by polymerization of acrylic acid and/or methacrylic acid and/or the acid chlorides thereof and/or the anhydrides thereof with further copolymerizable water-soluble monomers and with copolymerizable water-insoluble monomers and subsequent reaction of the polymers with amines. According to DIN 75201 B (gravimetry), 1.2 mg and 1.5 mg are mentioned for leathers which have been treated with the example products mentioned, the leathers treated with the comparative products (Magnopal SOF, low-fogging polymer fatliquoring agent, and Chromopol LFC, low-fogging fatliquoring agent based on fish oils, both from Stockhausen GmbH & Co. KG) achieved values of 3.9 mg and 3.5 mg. The reflectometric values according to DIN 75201 A of the example products are 51% and 55% and those of the comparative products are 34% and 40%.

U.S. Pat. No. 5,348,807 describes a process in which selected amphiphilic polymers are used as solvent-free low-fogging fatliquoring agents.

In addition to these polymers, EP 0 753 585 A2 describes a low-fogging surface treatment for upholstery leather and a process in which a specially treated natural oil acts as a basis for fatliquoring agents. Natural oils used are soybean, lard, safflower and sunflower oil. These oils having a fatty acid content ($<C_{16}$) of less than 3% are distilled and then reacted with bisulfite or bisulfate, emulsified and used.

For ecological reasons, the demand for high-exhaustion fatliquoring agents also increases. In this case, the fatliquoring agent must be taken up as completely as possible by the collagen. In the case of wet blue semifinished products, the generally anionic fatliquoring agent is fixed by the chromium(III) cations. In the case of wet white semifinished products which are produced without cationic metal salts, these binding sites are therefore absent. Consequently, the use of commercial fatliquoring agents prepared according to the prior art results in poor bath exhaustion, i.e. the residual liquor has a high COD. According to the prior art, the bath exhaustion is improved by chemical modification of the fatliquoring agent, which as a rule is effected by precipitation of the fatliquoring components on the leather surface. As a result of this, the compounds are not fixed in the leather, thus leading to leathers having high fogging values according to DIN 75201.

Common to all prior art processes described is that they describe either natural polymers or natural fatliquoring agents and that these products are special classes of substances. Moreover, none of these processes take into account the environmental aspect with regard to very good liquor exhaustion.

DE 101 43 949 A1 describes a fatliquoring mixture which contains a combination of a chemically modified natural fatliquoring component or, alternatively, of a polymeric component comprising a special emulsifier combination and which is characterized by excellent leather properties and outstanding liquor exhaustion. This composition also has a relatively high viscosity which is of considerable advantage for practical use in the tannery and is therefore a desirable property of leather fatliquoring agents.

It is an object of the present invention to provide a fatliquoring agent which avoids the disadvantages of the known fatliquoring agents and in particular combines the advantageous product properties of synthetic polymeric and natural fatliquoring components, which is manifested, inter alia, in the softness of the leather in combination with tight grain and good body in the case of, in particular, leather tanned without chromium. Furthermore, the fogging limits required by the market should be capable of being complied with by the product.

The present invention accordingly relates to a fatliquoring agent for the production and/or for the treatment of leather, comprising (A) at least one natural lipoid;

(B) at least one polymer based on the monomers acrylic acid and/or methacrylic acid;

(C) an emulsifier composition containing a $C_6$- to $C_{17}$-alkanol alkoxylated with up to 12 alkylene oxide units or a mixture of two or more such alkanols and a $C_{12}$- to $C_{24}$-fatty alcohol mixture alkoxylated with at least 15 alkylene oxide units.

There are in general no particular restrictions with regard to natural lipoid provided that the desired product properties can be established therewith. Inter alia, in principle fats, fatty oils, waxes and phospholipoids can be used as natural lipoids.

For the purposes of the present invention, inter alia phospholipoids are preferably used—which are known to be phosphoric diesters—in which the phosphoric acid may have been esterified on the one hand with glycerol or sphingosine and on the other hand with choline, colamine, serine or inositol.

Also preferably used as natural lipoids for the purposes of the present invention are, inter alia, natural fats or fatty oils which may be of vegetable or animal origin. For example, glycerides of natural fatty acids having a sufficient proportion of unsaturated acids may be mentioned in particular.

Said natural fats or fatty oils and the phospholipoids may each be present alone or as a mixture. Thus, it is possible to use a phospholipoid or a mixture of two or more phospholipoids or a fat or fatty oil or a mixture of two or more fats or fatty oils. It is also possible to use a mixture of at least one phospholipoid and at least one fat or fatty oil. For the purposes of the present invention, a mixture of at least one natural oil and at least one natural phospholipoid is preferably used.

In general, the at least one natural oil and the at least one natural phospholipoid can be used as such. It is also possible, for example, to use at least one natural oil or at least one natural phospholipoid or both at least one natural oil and at least one natural phospholipoid in chemically modified form.

According to a preferred embodiment, lipoid mixtures in which each of the natural oils and each of the natural phospholipoids have been chemically modified are used.

Accordingly, the present invention also describes a fatliquoring agent, as described above, which comprises, as at least one chemically modified, natural lipoid, a mixture comprising (Aa) at least one chemically modified, natural oil and (Ab) at least one chemically modified, natural phospholipoid.

Regarding this mixture according to the present invention of chemically modified, natural oil and chemically modified, natural phospholipoid, there are no particular restrictions for the individual compounds with regard to the proportion of the mixture or of the fatliquoring agent.

In general, the mixture according to (A) comprises from 20 to 50, preferably from 25 to 45, particularly preferably from 30 to 40, % by weight, based in each case on the total weight of the mixture (A), of the at least one chemically modified, natural oil.

Regarding the at least one chemically modified, natural phospholipoid, the mixture according to (A) generally comprises from 50 to 80, preferably from 55 to 75, particularly preferably from 60 to 70, % by weight.

Accordingly, the present invention also relates to a fatliquoring agent, as described above, which comprises the component (Aa) in an amount of from 20 to 50% by weight and the component (Ab) in an amount of from 50 to 80% by weight, based in each case on the total weight of the component (A).

Regarding the at least one chemically modified, natural oil according to (Aa) preferably used as described above, there are substantially no restrictions for the type of oil and of chemical modification, provided that the desired product properties can be achieved therewith. Natural oils which have an iodine number of from about 10 to about 200 are preferred. Natural oils having a low iodine number in said range are, for example, olein or tung oil, natural oils having a high iodine number in said range, for example the fish oils, or chaulmoogra oil.

Natural oils having an iodine number of from 10 to 200, preferably from 30 to 120, particularly preferably from 40 to 85, are preferably used in the fatliquoring agent according to the present invention.

Examples of further particularly preferred natural oils are fish oil, bone oil, nit oil, neatsfoot oil, lard oil, soybean oil, rapeseed oil, nut oil, olive oil, triolein or castor oil.

As already described above, these natural oils are chemically modified in a suitable manner for the purposes of the present invention. In general, this chemical modification comprises subjecting the C—C double bonds contained in the natural oils to at least partial addition and/or oxidation reactions. Preferably, the natural oils are modified by addition of sulfites at the double bonds, with the result that sulfonic acid groups are introduced. It is also preferred to introduce oxygen functions by atmospheric oxidation, or oligomerizations can occur. Also preferably, hydrolysis or partial hydrolysis of the natural oils, transesterifications or similar reactions are also possible as chemical modification.

Modified natural oils which have a relatively high degree of oxidation and a relatively low degree of sulfatation are particularly advantageous in the context of the fatliquoring agent according to the present invention, the chemically modified oils forming by reaction of the olefinic double bonds present in the oils with the oxidizing reagents and/or the sulfitation reagents. In particular, all of the olefinic double bonds present in the natural oils or only a part thereof may react with the oxidizing reagents and/or the sulfitation reagents.

A preferably used oxidizing reagent is, inter alia, air, the reaction with the olefinic double bonds present in the natural oils taking place at, for example, preferably from 60 to 80° C. The oxidation can also be effected by other methods known to the person skilled in the art. The term "relatively high degree of oxidation" as used in the context of the present application refers to a degree of oxidation of the natural oils which results in a difference between the specific weights of the oil before and after the oxidation, $\Delta d$, of in general from 0.01 to 0.1, preferably from 0.01 to 0.07, particularly preferably from 0.02 to 0.05, g/ml.

The sulfitation discussed above is generally effected by reacting the natural oil with aqueous bisulfite solution. It can also be effected by other methods known to the person skilled in the art. The term "relatively low degree of sulfitation" as used in the context of the present application refers to a degree of sulfitation of the natural oils which results from a reaction of the natural oil with in general from 2 to 8, preferably from 3 to 5, % by weight of sulfite, calculated as sodium bisulfite ($Na_2S_2O_5$) and based on the weight of the natural oil.

An oil oxidized and sulfatized as described above and selected from the group consisting of fish oil, neatsfoot oil, lard oil, soybean oil, rapeseed oil, nut oil, olive oil and castor oil is used as a very particularly preferred chemically modified, natural oil in the fatliquoring agent according to the present invention, oxidized and sulfatized rapeseed oil furthermore preferably being used as a chemically modified, natural oil.

Accordingly, the present invention also relates to a fatliquoring agent as described above, wherein a chemically modified, natural oil according to (Aa) is oxidized, sulfatized rapeseed oil.

According to a very particularly preferred embodiment of the fatliquoring agent according to the present invention, oxidized, sulfatized rapeseed oil is used as the only chemically modified, natural oil according to (Aa).

Examples of particularly preferred phospholipoida are lecithin and cephalin, it being possible, as described above, also to use, for example, chemically unmodified lecithin or chemically unmodified cephalin.

Accordingly, the present invention also describes a fatliquoring agent as described above, wherein a natural phospholipoid is chemically unmodified lecithin.

Modified phospholipoids which are partially acetylated and in which an esterified fatty acid has therefore been replaced by esterified acetic acid by methods known to the person skilled in the art are furthermore preferred. As a result of this partial transesterification, the viscosity and the hydrophilic properties of the modified phospholipoid can be adjusted. Acetylated lecithin is used as a particularly preferred modified phospholipoid for the purposes of the present invention.

The degree of acetylation of the modified phospholipoid is in general up to 60%, preferably up to 50%, particularly preferably from 30 to 50%, especially preferably from 35 to 45%.

Accordingly, the present invention also relates to a fatliquoring agent as described above, wherein a chemically modified, natural phospholipoid is acetylated lecithin.

Regarding the at least one polymer based on the monomers acrylic acid and/or methacrylic acid, there are no particular restrictions in this respect provided that the desired product property is achievable therewith.

The polymer used according to the invention and based on the monomers acrylic acid and/or methacrylic acid generally has a molecular weight $M_w$ of from 2 500 to 150 000, preferably from 5,000 to 130,000, more preferably from 10,000 to 110,000, particularly preferably from 25,000 to 100,000, especially preferably from 50,000 to 90,000, g/mol.

The polymer is further preferably used as an aqueous solution or dispersion of at least one salt of the polymer in the process according to the present invention.

Accordingly, at least one carboxyl group of the polymer used according to the present invention is present as a salt, monovalent ions, for example the alkali metal ions, such as lithium, sodium, potassium, rubidium or cesium, or an ammonium ion, being used as preferred cations of the salt, it being possible to use, for example, $NH_4^+$ or else a suitable mono-, di-, tri- or tetraalkylammonium ion as the ammonium ion.

The polymer salt used according to the invention may have, for example, one or more different cations from among the abovementioned ones. Where two or more different polymers are used, the different polymers may, independently of one another, have a single cation or two or more different cations from among the abovementioned ones.

According to a particularly preferred embodiment of the novel composition, the at least one polymer is used in the form of a sodium salt.

If, according to a preferred embodiment, an acrylic acid homopolymer is used, in general from 20 to 80%, preferably from 30 to 70%, particularly preferably from 40 to 60%, of the carboxyl groups of the polymer are present in the form of a salt, particularly preferably in the form of the sodium salt.

If, according to a further preferred embodiment, a methacrylic acid homopolymer is used, in general from 5 to 60%, preferably from 10 to 50%, particularly preferably from 20 to 40%, of the carboxyl groups of the polymer are present in the form of a salt, particularly preferably in the form of the sodium salt.

Homopolymers of acrylic acid monomers and homopolymers of methacrylic acid monomers are preferably used for the purposes of the present invention, homopolymers of acrylic acid monomers being more preferably used.

Accordingly, the present invention also describes a fatliquoring agent as described above, wherein a polymer according to (B) is a polyacrylic acid.

Accordingly, the present invention also describes a fatliquoring agent as described above, wherein the at least one polymer according to (B) is a polyacrylic acid having a molecular weight of from 2,500 to 150,000 g/mol.

For the purposes of the present invention, it is also possible to use mixtures of two or more polyacrylic acids, the molecular weights of different polyacrylic acids being in the abovementioned ranges. For example, polyacrylic acid mixtures in which one polyacrylic acid has a molecular weight $M_w$ of from 2,500 to 70,000 or from 5,000 to 50,000 or from 10,000 to 25,000 g/mol and another polyacrylic acid has a molecular weight $M_w$ of from 70,000 to 150,000 or from 90,000 to 130,000 or from 100,000 to 110,000 g/mol are accordingly conceivable. Mixtures of three or more polyacrylic acids having different molecular weights are also conceivable.

Mixtures of at least one acrylic acid homopolymer and at least one methacrylic acid homopolymer can also be used in the composition according to the present invention, it being possible for the individual different homopolymers, independently of one another, each to have different molecular weights.

Instead of or in addition to the homopolymers described above, copolymers of acrylic acid and methacrylic acid may also be used according to the present invention. Instead of acrylic acid or methacrylic acid, other ethylenically unsaturated monomers, for example itaconic acid, fumaric acid, maleic acid or the anhydrides thereof, may be used as comonomer. The use of suitable, acidically or basically substituted acrylates or methacrylates is also possible. For example, terpolymers of acrylic acid, methacrylic acid and one of the abovementioned further monomers can also be used.

As already described above, the polymers are used, according to the present invention, preferably in the form of an aqueous solution or dispersion. Depending on the polymer or polymer mixture, it is possible for at least one polymer to be present in solution and at least one further polymer to be present in dispersed form in the aqueous mixture.

The aqueous solution or dispersion contains the polymer in general in an amount of from 5 to 40, preferably from 10 to 40, more preferably from 20 to 40, particularly preferably from 25 to 35, % by weight, based in each case on the total weight of the aqueous solution or of the aqueous dispersion.

The aqueous solution or dispersion may contain, in addition to water, at least one solubilizer or at least one further solvent or both at least one solubilizer and at least one further solvent. Examples of solubilizers are glycols, wherein, for example diethylene glycol, dipropylene glycol, butyldiglycol, hexylene glycol or oligoethylene glycols having 3 to 7 ethylene units are particularly preferred.

Regarding the emulsifier composition according to (C), there are substantially no restrictions with respect to the individual alkanols and the fatty alcohols.

The alkylene oxide units are in general alkylene oxide units having at least 2, preferably 2 to 4, particularly preferably 2 to 3, carbon atoms. Ethylene oxide units are particularly preferred. The alkylene oxide units of the respective polyether chains may be identical or different. In the latter case, the alkylene oxide units may be arranged randomly or blockwise or partly blockwise.

The alkoxylated alkanols or fatty alcohols used according to the present invention are generally obtained from the reaction of the corresponding alkanols or mixtures of two or more thereof or fatty alcohols or mixtures of two or more thereof with the desired molar amounts of the alkylene oxides, for example ethylene oxide, propylene oxide or butylene oxide. Depending on the manner in which the alkylene oxides are metered into the batches, random or block-like or both random and block-like polyether chains can be produced in a controlled manner. Such reactions can be catalyzed, for example, by small amounts of water and/or added alkalis.

The emulsifier compositions according to the present invention are generally prepared by mixing the components with stirring and, if required, gentle heating, whereupon the prepared emulsifier mixture is used for the preparation of the fatliquoring agent according to the present invention.

The emulsifier composition can, if required, be converted, by adding water, into a solution which has, for example, a solids content of from about 40 to about 80% by weight, based on the total weight of the emulsifier composition. Other concentrations of the emulsifier compositions are possible. This solution can then be used for the preparation of the novel fatliquoring agent.

It is also conceivable to add the individual components of the emulsifier composition separately from one another in the preparation of the fatliquoring agent without preparing a mixture of the individual emulsifier components beforehand.

According to a preferred embodiment of the novel fatliquoring agent, a $C_{12}$- to $C_{24}$-fatty alcohol mixture which is alkoxylated with at least 15 alkylene oxide units and contains on the one hand a $C_{12}$- to $C_{24}$-fatty alcohol mixture alkoxylated with 15 to 30 alkylene oxide units and on the other hand a $C_{12}$- to $C_{24}$-fatty alcohol mixture alkoxylated with 40 to 100 alkylene oxide units is used.

Accordingly, the present invention also relates to a fatliquoring agent as described above, which comprises, as component (C), (Ca) a $C_6$- to $C_{1-7}$-alkanol alkoxylated with 4 to 12 alkylene oxide units or a mixture of two or more such alkanols and (Cb) a $C_{12}$- to $C_{24}$-fatty alcohol mixture alkoxylated with 15 to 30 alkylene oxide units and (Cc) a $C_{12}$- to $C_{24}$-fatty alcohol mixture alkoxylated with 40 to 100 alkylene oxide units.

The present invention also describes the emulsifier composition per se, comprising (Ca) a $C_6$- to $C_{1-7}$-alkanol alkoxylated with 4 to 12 alkylene oxide units or a mixture of two or more such alkanols and (Cb) a $C_{12}$- to $C_{24}$-fatty alcohol mixture alkoxylated with 15 to 30 alkylene oxide units and (Cc) a $C_{12}$- to $C_{24}$-fatty alcohol mixture alkoxylated with 40 to 100 alkylene oxide units.

According to a further particularly preferred embodiment of the fatliquoring agent according to the present invention, the emulsifier component according to (Ca) has on average 8 to 17, particularly preferably 10 to 17, particularly preferably 13 to 15, carbon atoms and the emulsifier components according to (Cb) and (Cc), independently of one another, have on average 14 to 20, particularly preferably on average 16 to 18, carbon atoms.

Furthermore, the emulsifier compositions in which the component (Ca) has on average 5 to 10 alkylene oxide units, the component (Cb) has on average 20 to 30 alkylene oxide units and the component (Cc) has on average 50 to 100 alkylene oxide units are preferred.

The emulsifier composition (C) contains the component (Ca) in general in an amount of from 40 to 80, preferably from 45 to 75, particularly preferably from 50 to 70, % by weight, based in each case on the total weight of the emulsifier composition.

The component (Cb) is contained in the emulsifier composition (C) in general in an amount of from 10 to 50, preferably from 10 to 40, particularly preferably from 15 to 30, % by weight, based in each case on the total weight of the emulsifier composition.

The component (Cc) is contained in the emulsifier composition (C) in general in an amount of from 10 to 50, preferably from 10 to 40, particularly preferably from 15 to 30, % by weight, based in each case on the total weight of the emulsifier composition.

Accordingly, the present invention also relates to a fatliquoring agent as described above, wherein the emulsifier composition according to (C) contains the component (Ca) in an amount of from 40 to 80% by weight, the component (Cb) in an amount of from 10 to 50% by weight and the component (Cc) in an amount of from 10 to 50% by weight, based in each case on the weight of the component (C).

The present invention therefore also describes the emulsifier composition per se, comprising (Ca) from 50 to 70% by weight of a $C_{13}$- to $C_{15}$-alkanol alkoxylated with 5 to 10 alkylene oxide units or a mixture of two or more such alkanols and (Cb) from 15 to 30% by weight of a $C_{16}$- to $C_{18}$-fatty alcohol mixture alkoxylated with 20 to 30 alkylene oxide units and (Cc) from 15 to 30% by weight of a $C_{16}$- to $C_{18}$-fatty alcohol mixture alkoxylated with 50 to 100 alkylene oxide units, the stated percentages by weight being based in each case on the weight of the component (C) and the sum of the stated percentages by weight of (Ca), (Cb) and (Cc) being 100.

The present invention also describes very generally the use of the component (Ca) or (Cb) or (Cc) or of the components (Ca) and (Cb) or of the components (Cb) and (Cc) or of the components (Ca) and (Cc) or of the components (Ca) and (Cc) for the production and/or treatment of leather.

In general, the fatliquoring agents according to the present invention contain the components (A), (B) and (C) in amounts of from 50 to 90% by weight with regard to the component (A), from 5 to 25% by weight with regard to the component (B) and from 1 to 10% by weight with regard to the component (C), the weight of the component (B) being calculated as the weight of the aqueous solution or dispersion of the at least one polymer.

Accordingly, the present invention also relates to a fatliquoring agent as described above, wherein the component (A) is contained in an amount of from 50 to 90% by weight, the component (B) in an amount of from 5 to 25% by weight and the component (C) in an amount of from 1 to 10% by weight, the weight of the component (B) being calculated as the weight of the aqueous solution or dispersion of the at least one polymer.

According to a preferred embodiment, the novel fatliquoring agents contain the components (A), (B) and (C) in amounts of from 55 to 85% by weight with respect to the component (A), from 10 to 25% by weight with respect to the component (B) and from 2 to 9% by weight with respect to the component (C), the weight of the component (B) being calculated as the weight of the aqueous solution or dispersion of the at least one polymer.

According to a particularly preferred embodiment, the novel fatliquoring agents contain the components (A), (B) and (C) in amounts of from 60 to 80% by weight with respect to the component (A), from 10 to 20% by weight with respect to the component (B) and from 3 to 8% by weight with respect to the component (C), the weight of the component (B) being calculated as the weight of the aqueous solution or dispersion of the at least one polymer.

In addition to the components (A), (B) and (C) described above, the fatliquoring agents according to the present invention may also contain further suitable components. For example, further fatliquoring agents known from the prior art may be contained in the fatliquoring agent according to the present invention. Furthermore, additional emulsifiers and/or diluents, in particular water, may be present. For example, glycols are preferably contained in the fatliquoring agent, for example diethylene glycol, dipropylene glycol, butyldiglycol, hexylene glycol or oligoethylene glycols having 3 to 7 ethylene units being particularly preferred. According to a particularly preferred embodiment, the novel composition contains dipropylene glycol.

According to a preferred embodiment, the novel composition contains said at least one further component, for example preferably the at least one glycol, preferably dipropylene glycol, in an amount of in general from 1 to 20, preferably from 3 to 17, particularly preferably from 5 to 15, % by weight, based in each case on the total weight of the composition.

The novel composition can be prepared by all suitable methods. In particular, the sequence in which the components contained in the novel composition are combined is substantially arbitrary, provided that the processibility is ensured. In the preparation of the novel composition, it is in particular conceivable that, for example, a mesophase occurs which, for example, adversely affects the stirability of the composition it is therefore preferable if, for example, the at least one natural lipoid is initially taken, the at least one polymer based on the monomers acrylic acid and/or methacrylic acid is then added and thereafter the emulsifier composition is added. This may be followed, for example, by the addition of further solvent, for example for establishing the desired degree of dilution. In a likewise preferred embodiment, the emulsifier composition is not prepared in a separate step and then added as such, but the components of the emulsifier composition are used individually and in succession for the preparation of the novel fatliquoring agent. If, for example, a modified, natural oil, as the at least one lipoid, and a natural phospholipid are used, it is particularly preferred initially to take the oil and then to add the phospholipid, the oil and the phospholipid particularly preferably being mixed with one another at from 40 to 50° C.

The present invention furthermore relates to the use of the fatliquoring agents described above in the production and/or the treatment of leather. In particular, the fatliquoring agents according to the present invention are used for softening leather, increasing its body and strength and protecting it from moisture, dirt and external chemical influences.

Accordingly, the present invention also relates to the use of a fatliquoring agent as described above in the production or the treatment or in the production and treatment of leather and hides.

In the case of the use according to the present invention, the fatliquoring agents according to the present invention may be employed undiluted or, for example, as an aqueous dispersion. According to a preferred embodiment, such aqueous dispersions contain solids in an amount of from 40 to 80, particularly preferably from 50 to 80, in particular from 60 to 75, % by weight.

The present invention therefore also relates to a process for the fatliquoring of leather and hides, the leather or the hides being brought into contact with at least one aqueous dispersion, wherein the at least one aqueous dispersion contains a fatliquoring agent as described above in an amount of from 40 to 80% by weight.

For the purposes of the present invention, it is particularly preferred to prepare a fatliquoring agent, containing the abovementioned components, as a highly concentrated product. In this way, it is possible for the tanner to dilute the product according to his own concepts and specifications and to use it specifically. For fatliquoring compositions concentrated in such a manner, there are furthermore low transport costs owing to the lower weight. In the case of this highly concentrated product, it is preferable, for example, to predilute the product before use, degrees of dilution of, for example, from 1:4 to 1:5 being preferred. The degree of dilution 1:4 means that 4 parts by weight of solvent, for example preferably water, are used per part by weight of product.

The examples which follow illustrate the present invention.

EXAMPLES

Example 1

Preparation of a Fatliquoring Agent According to the Present Invention 500 kg of oxidized, sulfatized rapeseed oil ($\Delta d$=0.03, organically bound $SO_3$ 4%) were mixed with 900 kg of acetylated soybean lecithin at 40° C. in a stirred kettle having an anchor stirrer.

After 1 hour, 300 kg of a sodium salt of polyacrylic acid (0.5 mol of NaOH, based on COOH of the polyacrylic acid, pH from 4.5 to 5.5, solids content 30%, $M_w$=70,000 g/mol), 60 kg of a $C_{13}/C_{15}$-fatty alcohol mixture (fatty alcohol $C_{13}/C_{15}$ ethoxylate having 7 mol of EO), 20 kg of a $C_{16}/C_{18}$-fatty alcohol mixture (fatty alcohol $C_{16}/C_{18}$ ethoxylate having 80 mol of EO) and 20 kg of a further $C_{16}/C_{18}$-fatty alcohol mixture (fatty alcohol $C_{16}/C_{18}$ ethoxylate having 25 mol of EO) and 200 kg of dipropylene glycol were mixed in succession.

For complete homogenization, stirring was continued for a further hour.

Example 2

Preparation of a Comparative Fatliquoring Agent 500 g of oxidized, sulfated rapeseed oil (Δd=0.03, organically bound $SO_3$ 4%) were initially taken at 40° C. in a stirred flask.

Thereafter, 300 g of a sodium salt of a polyacrylic acid (0.5 mol of NaOH, based on COOH of the polyacrylic acid, pH from 4.5 to 5.5, solids content 30%, $M_w$=70,000 g/mol), 60 g of a $C_{13}/C_{15}$-fatty alcohol mixture (fatty alcohol $C_{13}/C_{15}$ ethoxylate having 7 mol of EO), 20 g of a $C_{16}/C_{18}$-fatty alcohol mixture (fatty alcohol $C_{16}/C_{18}$ ethoxylate having 80 mol of EO) and 20 g of a further $C_{16}/C_{18}$-fatty alcohol mixture (fatty alcohol $C_{16}/_{18}$ ethoxylate having 25 mol of EO) and 200 g of dipropylene glycol were mixed in succession.

For complete homogenization, stirring was continued for a further hour.

Example 3

Leather Production Using the Fatliquoring Agent According to the Present Invention 100 parts by weight of chrome cattle leather having a shaved thickness of from 1.4 to 1.6 mm were placed in 100 parts by weight of water at 35° C. and brought to a pH of 4.5 by adding sodium formate and sodium bicarbonate. The leather was drummed at 25° C. for 90 minutes and then washed with 100 parts by weight of water.

After the liquor had been discharged, retanning was effected by adding a further 100 parts by weight of water (all at 35° C.) and then 2 parts by weight of high molecular weight polymer tanning agent (Relugan® RE). After agitation for 15 minutes in the drum, 1 part by weight of synthetic auxiliary tanning agent (Tamol® M) was added and agitation was carried out for a further 15 minutes. 4 parts by weight of vegetable tanning agent (Mimosa) and 4 parts by weight of resin tanning agent (Relugan® D and S) were then added.

After agitation for 60 minutes, the pH was brought to 5.5 with sodium bicarbonate. 1.5 parts by weight of an acid-substantive leather dye (Luganil® brown NGB) were then added. After 45 minutes in the agitated drum, the pH was brought to 3.6 with formic acid in the course of 30 minutes before fixing. The liquor was then discharged again and washing was effected with 100 parts by weight of water at 60° C.

Fatliquoring was then effected by adding a further 100 parts by weight of water (60° C.) and 5 percent by weight of the fatliquoring agent prepared according to example 1, in a dilution of 1:5 with water.

Drumming was then effected for 60 minutes at 60° C., a further 100 parts by weight of water were added, drumming was effected for 15 minutes and the pH was brought to 3.7 by adding formic acid and the fat was fixed by adding a cationic fixing agent (Bastamol® B). After the liquor had been discharged and further washing effected with 200 parts by weight of water, the leather was dried (drying by suspension), conditioned and staked.

The leather thus obtained was characterized by excellent softness in combination with tightness of the grain, excellent body and a pleasant, velvet-like handle.

Example 4

Leather Production Using the Comparative Fatliquoring Agent

Example 4 was carried out analogously to example 3, the comparative fatliquoring agent prepared according to example 2 being used in the fatliquoring step instead of the novel fatliquoring agent.

The leather thus obtained was characterized by only moderate softness in combination with poor tightness of the grain and good body. Moreover, the pleasant, velvet-like handle of the leather described in example 3 was absent.

We claim:

1. A fatliquoring agent for the production and/or for the treatment of leather, comprising (A) at least one natural lipoid;

(B) at least one polymer based on monomers of acrylic acid and/or methacrylic acid;

(C) an emulsifier composition containing a $C_6$- to $C_{17}$-alkanol alkoxylated with up to 12 alkylene oxide units or a mixture of two or more such alkanols and a $C_{12}$- to $C_{24}$-fatty alcohol mixture alkoxylated with at least 15 alkylene oxide units.

2. The fatliquoring agent of claim 1, which comprises, as at least one natural lipoid, a mixture comprising (Aa) at least one chemically modified, natural oil in an amount of from 20 to 50% by weight and (Ab) at least one natural phospholipid in an amount of from 50 to 80% by weight, based in each case on the total weight of the component (A).

3. The fatliquoring agent of claim 2, wherein a chemically modified, natural oil according to (Aa) is oxidized, sulfatized rapeseed oil.

4. The fatliquoring agent of claim 2, wherein a chemically modified, natural phospholipid is acetylated lecithin,

5. The fatliquoring agent of claim 1, wherein a polymer according to (B) is a polyacrylic acid having a molecular weight of from 2,500 to 150,000 g/mol.

6. The fatliquoring agent of claim 1, which comprises, as component (C), (Ca) a $C_6$- to $C_{17}$-alkanol alkoxylated with 4 to 12 alkylene oxide units or a mixture of two or more such alkanols and (Cb) a $C_{12}$- to $C_{24}$-fatty alcohol mixture alkoxylated with 15 to 30 alkylene oxide units and (Cc) a $C_{12}$- to $C_{24}$-fatty alcohol mixture alkoxylated with 40 to 100 alkylene oxide units.

7. The fatliquoring agent of claim 6, wherein the emulsifier composition according to (C) contains the component (Ca) in an amount of from 20 to 60% by weight, the component (Cb) in an amount of from 20 to 70% by weight and the component (Cc) in an amount of from 10 to 50% by weight, based in each case on the weight of the component (C).

8. The fatliquoring agent of claim 1, which comprises the component (A) in an amount of from 50 to 90% by weight, the component (B) as an aqueous solution or dispersion in an amount of from 5 to 25% by weight and the component (C) in an amount of from 1 to 10% by weight, the weight of the component (B) being calculated as the weight of the aqueous solution or dispersion.

9. A process for the fatliquoring of leather and hides which comprises contacting the leather or the hides with at least one aqueous dispersion, wherein the at least one aqueous dispersion contains a fatliquoring agent according to claim 8 in an amount of from 40 to 80% by weight.

10. A process for the treatment of leather and hides which comprises contacting the leather or the hides with a fat liquoring agent wherein said agent comprises (A) at least one natural lipoid;

(B) at least one polymer based on monomers of acrylic acid and/or methacrylic acid;

(C) an emulsifier composition containing a $C_6$- to $C_{17}$-alkanol alkoxylated with up to 12 alkylene oxide units or a mixture of two or more such alkanols and a $C_{12}$- to $C_{24}$-fatty alcohol mixture alkoxylated with at least 15 alkylene oxide units.

11. The process of claim 10, said agent comprising, as at least one natural lipoid, a mixture comprising (Aa) at least one chemically modified, natural oil in an amount of from 20 to 50% by weight and (Ab) at least one natural phospholipid in an amount of from 50 to 80% by weight, based in each case on the total weight of the component (A), and comprising, as component (C), (Ca) a $C_6$- to $C_{17}$-alkanol alkoxylated with 4 to 12 alkylene oxide units or a mixture of two or more such alkanols and (Cb) a $C_{12}$- to $C_{24}$-fatty alcohol mixture alkoxylated with 15 to 30 alkylene oxide units and (Cc) a $C_{12}$- to $C_{24}$-fatty alcohol mixture alkoxylated with 40 to 100 alkylene oxide units, wherein the polymer according to (B) is a polyacrylic acid having a molecular weight of from 2,500 to 150,000 g/mol.

12. A process for the fatliquoring of leather and hides which comprises contacting the leather or the hides with at least one aqueous dispersion, wherein the at least one aqueous dispersion contains a fatliquoring agent in an amount of from 40 to 80% by weight, said agent comprising (A) at least one natural lipoid;

(B) at least one polymer based on monomers of acrylic acid and/or methacrylic acid;

(C) an emulsifier composition containing a $C_6$- to $C_{17}$-alkanol alkoxylated with up to 12 alkylene oxide units or a mixture of two or more such alkanols and a $C_{12}$- to $C_{24}$-fatty alcohol mixture alkoxylated with at least 15 alkylene oxide units.

13. The process of claim 12, said agent comprising, as at least one natural lipoid, a mixture comprising (Aa) at least one chemically modified, natural oil in an amount of from 20 to 50% by weight and (Ab) at least one natural phospholipid in an amount of from 50 to 80% by weight, based in each case on the total weight of the component (A), and comprising, as component (C), (Ca) a $C_6$- to $C_{17}$-alkanol alkoxylated with 4 to 12 alkylene oxide units or a mixture of two or more such alkanols and (Cb) a $C_{12}$- to $C_{24}$-fatty alcohol mixture alkoxylated with 15 to 30 alkylene oxide units and (Cc) a $C_{12}$- to $C_{24}$-fatty alcohol mixture alkoxylated with 40 to 100 alkylene oxide units, wherein the polymer according to (B) is a polyacrylic acid having a molecular weight of from 2,500 to 150,000 g/mol.

14. A process for the production of leather and hides which comprises contacting the leather or the hides with a fat liquoring agent said agent comprising (A) at least one natural lipoid;

(B) at least one polymer based on a monomer of acrylic acid and/or methacrylic acid;

(C) an emulsifier composition containing a $C_6$- to $C_{17}$-alkanol alkoxylated with up to 12 alkylene oxide units or a mixture of two or more such alkanols and a $C_{12}$- to $C_{24}$-fatty alcohol mixture alkoxylated with at least 15 alkylene oxide units.

15. The process of claim 14, said agent comprising, as at least one natural lipoid, a mixture comprising (Aa) at least one chemically modified, natural oil in an amount of from 20 to 50% by weight and (Ab) at least one natural phospholipid in an amount of from 50 to 80% by weight, based in each case on the total weight of the component (A), and comprising, as component (C), (Ca) a $C_6$- to $C_{17}$-alkanol alkoxylated with 4 to 12 alkylene oxide units or a mixture of two or more such alkanols and (Cb) a $C_{12}$- to $C_{24}$-fatty alcohol mixture alkoxylated with 15 to 30 alkylene oxide units and (Cc) a $C_{12}$- to $C_{24}$-fatty alcohol mixture alkoxylated with 40 to 100 alkylene oxide units, wherein the polymer according to (B) is a polyacrylic acid having a molecular weight of from 2,500 to 150,000 g/mol.

* * * * *